US010659870B2

(12) United States Patent
Shin et al.

(10) Patent No.: US 10,659,870 B2
(45) Date of Patent: May 19, 2020

(54) AUDIO DEVICE AND OPERATING METHOD OF AUDIO DEVICE

(71) Applicant: SAMSUNG ELECTRONICS CO., LTD., Suwon-si, Gyeonggi-do (KR)

(72) Inventors: Changseob Shin, Seoul (KR); Jonghwa Won, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 6 days.

(21) Appl. No.: 15/987,641

(22) Filed: May 23, 2018

(65) Prior Publication Data

US 2019/0098396 A1 Mar. 28, 2019

(30) Foreign Application Priority Data

Sep. 27, 2017 (KR) ..... 10-2017-0125039

(51) Int. Cl.

| | |
|---|---|
| ***H01R 24/58*** | (2011.01) |
| ***H04R 1/10*** | (2006.01) |
| ***H01R 13/66*** | (2006.01) |
| *H01R 107/00* | (2006.01) |

(52) U.S. Cl.

CPC ..... *H04R 1/1091* (2013.01); *H01R 13/6683* (2013.01); *H01R 24/58* (2013.01); *H01R 2107/00* (2013.01); *H04R 2420/05* (2013.01)

(58) Field of Classification Search

CPC ..... H04R 1/1091; H04R 2420/05; H01R 13/6683; H01R 24/58; H01R 2107/00

USPC ..... 381/74, 384, 370, 123, 122; 439/668, 439/669

See application file for complete search history.

(56) References Cited

U.S. PATENT DOCUMENTS

| | | | |
|---|---|---|---|
| 6,903,657 | B2 | 6/2005 | Kwoen |
| 6,980,777 | B2 | 12/2005 | Shepherd et al. |
| 7,050,837 | B2 | 5/2006 | Menz et al. |
| 7,121,873 | B2 | 10/2006 | Wu et al. |
| 7,161,491 | B2 | 1/2007 | Garcia et al. |
| 7,259,681 | B2 | 8/2007 | Kwoen |

(Continued)

FOREIGN PATENT DOCUMENTS

| | | |
|---|---|---|
| JP | 2009194890 | 8/2009 |
| KR | 0529471 | 11/2005 |

(Continued)

*Primary Examiner* — Vivian C Chin
*Assistant Examiner* — Con P Tran
(74) *Attorney, Agent, or Firm* — Volentine, Whitt & Francos, PLLC

(57) ABSTRACT

An audio device includes a jack slot detachably connectable with an audio jack; a detection and monitor unit constantly supplying a first voltage and a second voltage to the jack slot and detecting whether a conductive material is attached to the jack slot depending on changes in the first and second voltages, in a first detection mode; and a determination unit determining whether the conductive material is the audio jack depending on a change in at least one of the first and second voltages in response to detecting attachment of the conductive material. In response to determination by the determination unit that the conductive material is not the audio jack, the detection and monitor unit in a second detection mode monitors a change in the at least one of the first and second voltages while periodically supplying the first and second voltages to the jack slot.

20 Claims, 11 Drawing Sheets

(56) References Cited

U.S. PATENT DOCUMENTS

| | | | | |
|---|---|---|---|---|
| 8,155,337 | B2 | 4/2012 | Choi et al. | |
| 8,559,650 | B2 | 10/2013 | Seo | |
| 9,124,709 | B2 | 9/2015 | Lee | |
| 9,282,391 | B2 * | 3/2016 | Jung | H04R 1/1041 |
| 9,497,559 | B2 | 11/2016 | Prentice | |
| 9,602,941 | B2 | 3/2017 | Oh et al. | |
| 9,609,447 | B2 | 3/2017 | Miske et al. | |
| 2005/0201568 | A1 * | 9/2005 | Goyal | H04M 1/6058 381/74 |
| 2011/0018524 | A1 | 1/2011 | Fitzsimmons | |
| 2012/0074954 | A1 | 3/2012 | Jaeger et al. | |
| 2014/0055167 | A1 * | 2/2014 | Oh | G01R 31/024 327/63 |
| 2014/0072129 | A1 | 3/2014 | Jung | |
| 2014/0225632 | A1 * | 8/2014 | Oh | H02B 1/00 324/713 |
| 2015/0296310 | A1 * | 10/2015 | Chen | H04M 1/72591 381/315 |
| 2015/0377810 | A1 | 12/2015 | Roh et al. | |
| 2016/0380394 | A1 | 12/2016 | Park et al. | |

FOREIGN PATENT DOCUMENTS

| | | |
|---|---|---|
| KR | 0827305 | 4/2008 |
| KR | 20170039254 | 4/2017 |

* cited by examiner

AUDIO DEVICE AND OPERATING METHOD OF AUDIO DEVICE

CROSS-REFERENCE TO RELATED APPLICATIONS

A claim of priority under 35 U.S.C. § 119 is made to Korean Patent Application No. 10-2017-0125039 filed Sep. 27, 2017, in the Korean Intellectual Property Office, the entirety of which is hereby incorporated by reference.

BACKGROUND

The present disclosure relates to an electronic device, and more particularly to an audio device and a multimedia device including the audio device.

Multimedia devices such as smartphones or smart pads are configured to create and play video data and audio data. The audio data may be openly played through a speaker or may be played to be provided to a specific person through a personal playback device such as earphones or a headset.

A multimedia device is typically configured to play audio data through a speaker when a personal playback device is not connected to the multimedia device, and to play the audio data through a personal playback device when the personal playback device is connected to the multimedia device. To implement such functions, a multimedia device may include a jack detector that detects whether a jack of the personal playback device is attached to a jack slot of the multimedia device.

A jack detector may detect attachment of the audio jack by supplying voltages or currents to electrodes of the jack slot, and detecting whether a current flows through the electrodes of the jack slot. However, in the case where contaminants that are conductive (e.g., water or seawater) are attached to or present in the jack slot, a current may flow through the electrodes even though an audio jack is not attached to the jack slot. A jack slot may quickly corrode as a result of such current flow due to conductive contaminants.

SUMMARY

Embodiments of the inventive concept provide an audio device capable of preventing corrosion of a jack slot when contaminants with conductivity are attached to the jack slot, and an operating method of the audio device.

Embodiments of the inventive concept provide an audio device which includes a jack slot configured to be detachably connectable with an audio jack; a detection and monitor unit configured in a first detection mode constantly to supply a first voltage and a second voltage to the jack slot, and to detect whether a conductive material is attached to the jack slot depending on changes in the first and second voltages; and a determination unit configured to determine whether the conductive material is the audio jack depending on a change in at least one of the first and second voltages in response to detection by the detection and monitor unit that the conductive material is attached to the jack slot. In response to determination by the determination unit that the conductive material is not the audio jack, the detection and monitor unit is configured in a second detection mode to monitor the change in the at least one of the first and second voltages while periodically supplying the first and second voltages to the jack slot.

Embodiments of the inventive concept further provide an audio device that includes a jack slot configured to detachably connectable with an audio jack; a detection and monitor unit configured in a first detection mode to constantly supply a first voltage and a second voltage to the jack slot, and to detect whether a conductive material is attached to the jack slot depending on changes in the first and second voltages; an application processor configured to determine whether the conductive material is the audio jack depending on a change in at least one of the first and second voltages in response to detection by the detection and monitor unit that the conductive material is attached to the jack slot; and an audio codec configured to transmit an audio signal to the jack slot in response to determination by the application processor that the conductive material is the audio jack. In response to determination by the application processor that the conductive material is not the audio jack the detection and monitor unit is configured in a second detection mode to monitor the change in the at least one of the first and second voltages while periodically supplying the first and second voltages to the jack slot.

Embodiments of the inventive concept further provide an operating method of an audio device, the audio device including a detection and monitor unit, a determination unit, and a jack slot detachably connectable with an audio jack. The operating method includes detecting by the detection and monitor unit whether a conductive material is attached to the jack slot while constantly supplying a first voltage and a second voltage to the jack slot; determining by the determination unit whether the conductive material is the audio jack, in response to detecting by the detection and monitoring unit attachment of the conductive material to the jack slot; upon determining by the determination unit that the conductive material is the audio jack, detecting by the detection and monitor unit detachment of the audio jack while constantly supplying the first and second voltages to the jack slot; and upon determining by the determination unit that the conductive material is not the audio jack, monitoring by the detection and monitoring unit whether the conductive material is changed to the audio jack while periodically supplying the first and second voltages to the jack slot.

Embodiments of the inventive concept still further provide an audio device that includes a jack slot configured to be detachably connectable with an audio jack; and a detection and monitor unit configured in a first detection mode to constantly supply a first voltage and a second voltage to the jack slot to detect whether a conductive material is attached to the jack slot depending on changes in the first and second voltages, and configured in a second detection mode to periodically supply at least one of the first and second voltages to the jack slot to detect a change in a characteristic impedance of the conductive material attached to the jack slot.

BRIEF DESCRIPTION OF THE FIGURES

The above and other features of the inventive concept will be described with reference to the accompanying drawings.

DETAILED DESCRIPTION

Figure 1:
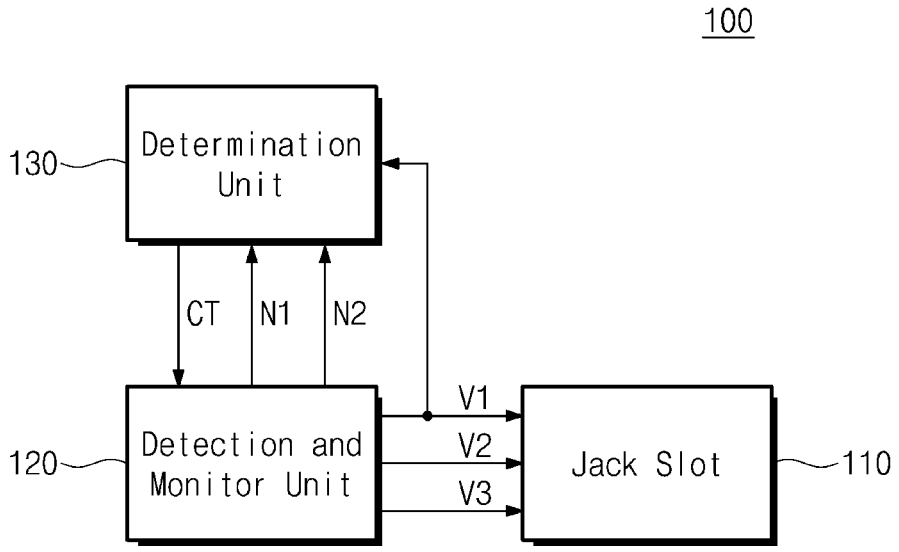
FIG. 1 illustrates a block diagram of an audio device according to an embodiment of the inventive concept.

Exemplary embodiments of the inventive concept will be described in detail hereinafter with reference to the accompanying drawings. Like reference numerals may refer to like elements throughout this application.

As is traditional in the field of the inventive concepts, embodiments may be described and illustrated in terms of blocks which carry out a described function or functions. These blocks, which may be referred to herein as units or modules or the like, are physically implemented by analog and/or digital circuits such as logic gates, integrated circuits, microprocessors, microcontrollers, memory circuits, passive electronic components, active electronic components, optical components, hardwired circuits and the like, and may optionally be driven by firmware and/or software. The circuits may, for example, be embodied in one or more semiconductor chips, or on substrate supports such as printed circuit boards and the like. The circuits constituting a block may be implemented by dedicated hardware, or by a processor (e.g., one or more programmed microprocessors and associated circuitry), or by a combination of dedicated hardware to perform some functions of the block and a processor to perform other functions of the block. Each block of the embodiments may be physically separated into two or more interacting and discrete blocks without departing from the scope of the inventive concepts. Likewise, the blocks of the embodiments may be physically combined into more complex blocks without departing from the scope of the inventive concepts.

FIG. 1 illustrates a block diagram of an audio device 100 according to an embodiment of the inventive concept. The audio device 100 may be for example a multimedia device such as smartphone, a smart pad or any device configured to create and play audio data and video data, or any device configured to create and play audio data. Referring to FIG. 1, the audio device 100 includes a jack slot 110, a detection and monitor unit 120, and a determination unit 130. The jack slot 110 may be configured so that an audio jack can be removably attached (i.e., connected) to the jack slot 110 and detached (i.e., disconnected) from the jack slot 110. That is, the jack slot 110 is configured to be attachable or connectable with an audio jack, whereby the audio jack may be detachably inserted into or detachably connected with the jack slot 110. In other words, the jack slot 110 is configured to be detachably connectable with an audio jack.

The detection and monitor unit 120 may supply first to third voltages V1 to V3 to the jack slot 110. The detection and monitor unit 120 may transmit first and second notifications N1 and N2 to the determination unit 130. The detection and monitor unit 120 may receive a control signal CT from the determination unit 130. The detection and monitor unit 120 may operate in one of a first detection mode and a second detection mode depending on the control signal CT.

In the first detection mode, the detection and monitor unit 120 constantly supplies at least one of the first to third voltages V1 to V3 to the jack slot 110, and detects whether a conductive material is attached to the jack slot 110. Hereinafter, the "attachment" of a conductive material to the jack slot 110 should be understood to mean that a conductive material (i.e., either the audio jack or a conductive contaminant) is present in the jack slot 110. If the attachment or presence of the conductive material is detected, the detection and monitor unit 120 transmits to the determination unit 130 the first notification N1 representing that attachment or presence of the conductive material is detected.

In the second detection mode, the detection and monitor unit 120 periodically supplies at least one of the first to third voltages V1 to V3 to the jack slot 110, and monitors whether a characteristic (e.g., impedance) of the conductive material attached to or present in the jack slot 110 changes. If the characteristic of the conductive material is changed, the detection and monitor unit 120 transmits to the determination unit 130 the second notification N2 representing a change in the characteristic of the conductive material.

The determination unit 130 may receive the first and second notifications N1 and N2 and at least one (e.g., the first voltage V1) of the first to third voltages V1 to V3 from the detection and monitor unit 120. When one of the first and second notifications N1 and N2 is received, the determination unit 130 may determine whether the conductive material attached to or present in the jack slot 110 is an audio jack based on the first voltage V1.

If the conductive material attached to or present in the jack slot 110 is the audio jack, the determination unit 130 may adjust the control signal CT to allow (i.e., direct) the detection and monitor unit 120 to operate in the first detection mode. If the conductive material attached to or present in the jack slot 110 is not the audio jack but is instead conductive contaminants such as water or seawater, the determination unit 130 may adjust the control signal CT to allow (i.e., direct) the detection and monitor unit 120 to operate in the second detection mode.

Figure 2:
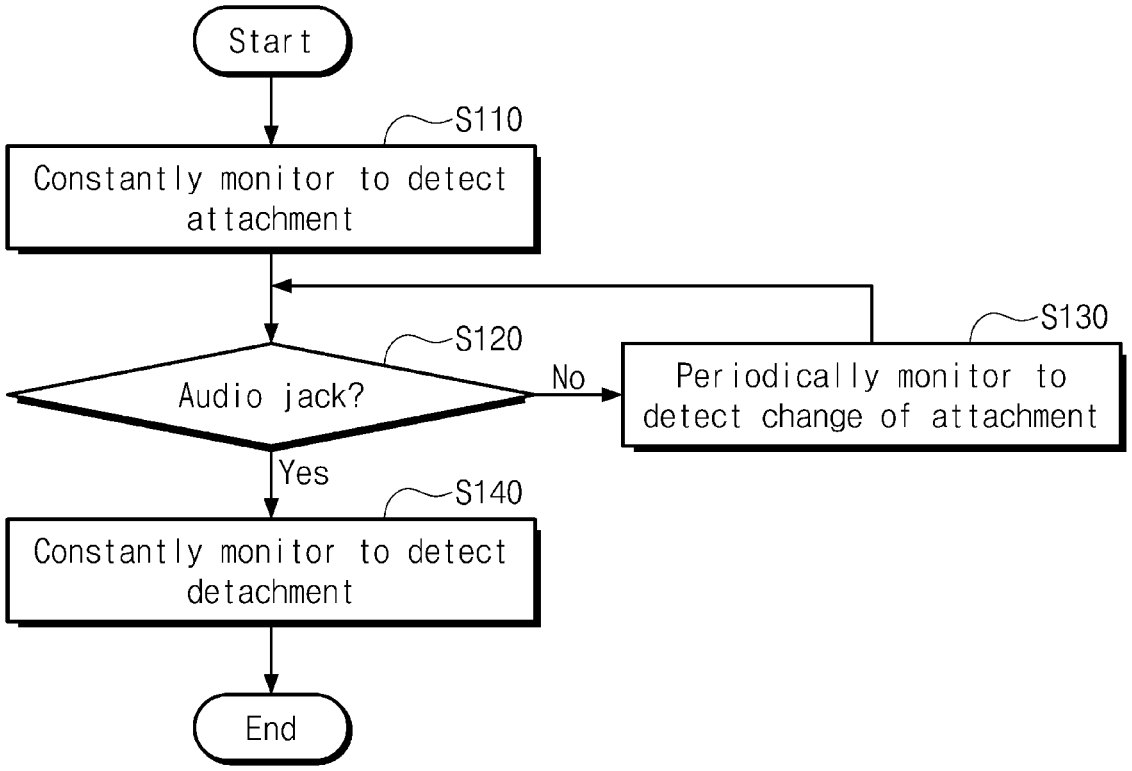
FIG. 2 illustrates a flowchart of an operating method of the audio device according to an embodiment of the inventive concept.

FIG. 2 illustrates a flowchart of an operating method of the audio device 100 according to an embodiment of the inventive concept. Referring to FIGS. 1 and 2, in operation S110, the audio device 100 constantly monitors to detect attachment or presence of conductive material in the jack slot 110. For example, the detection and monitor unit 120 constantly supplies at least one of the first to third voltages V1 to V3 (e.g., the first and second voltages V1 and V2) to the jack slot 110, to constantly detect whether a conductive material is attached to or present in the jack slot 110.

In operation S120, the audio device 100 determines a kind of the attachment, or in other words determines whether an audio jack is attached to the jack slot 110. For example, the detection and monitor unit 120 transmits the first notification N1 to the determination unit 130 in response to the detection of the attachment of a conductive material in operation S110. The determination unit 130 determines in operation S120 the kind of the attachment depending on a level of the first voltage V1. For example, the determination unit 130 may determine whether the attachment is an audio jack, or a conductive contaminant and therefore not the audio jack, depending on a level of the first voltage V1.

If the determination unit 130 determines that the conductive material attached to the jack slot 110 is not the audio jack (No in operation S120), in operation S130 the audio device 100 periodically monitors to detect a change of the attachment. For example, in operation S130 the detection and monitor unit 120 periodically applies the first and second voltages V1 and V2 to periodically determine whether impedance of the attachment changes. If the detection and monitor unit 120 detects that the impedance of the attachment changes in operation S130, operation S120 may thereafter be performed.

If the determination unit 130 determines in operation S120 that the conductive material attached to the jack slot 110 is the audio jack (Yes in operation S120), operation S140 is performed. In operation S140, the audio device 100 constantly monitors to detect detachment of the audio jack from the jack slot 110. For example, the detection and monitor unit 120 may constantly apply the first and second voltages V1 and V2 to the jack slot 110 to constantly detect whether the audio jack is detached from the jack slot 110.

According to an embodiment of the inventive concept, when a conductive material (e.g., a conductive contaminant) that is not an audio jack is attached to or present in the jack slot 110, the first and second voltages V1 and V2 are periodically (i.e., not constantly) applied to the jack slot 110, and thus a change (e.g., impedance) of the conductive material is periodically monitored. Since the first and second voltages V1 and V2 are supplied intermittently and not constantly, when a conductive contaminant is attached to the jack slot 110 a current flows through the conductive contaminant in the jack slot 110 intermittently as part of the monitoring but not constantly.

In general, when a conductive contaminant such as water or seawater is attached to a metal, metal corrosion may more rapidly occur when current flow through the metal and the contaminant than in absence of current flow. When a conductive contaminant is attached to a jack slot of an audio device, metal corrosion of the jack slot may more rapidly occur when current flow through the jack slot. However, according to embodiments of the inventive concept, when a conductive contaminant is detected in the jack slot 110, current flows in the jack slot 110 periodically (i.e., not constantly). Accordingly, corrosion of the jack slot 110 may be prevented (or suppressed) while maintaining the function of detecting an audio jack.

Figure 3:
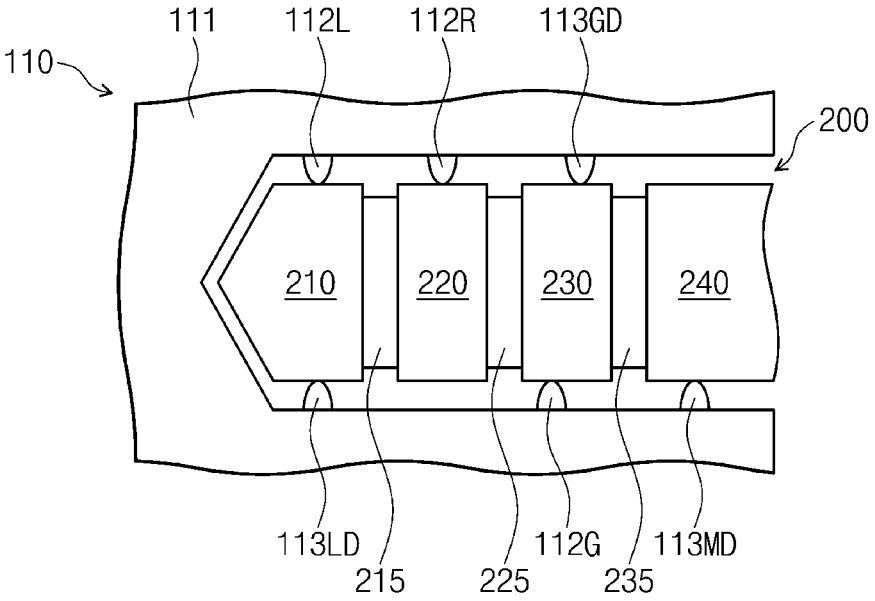
FIG. 3 illustrates an example in which an audio jack of an external personal playback device is attached to a jack slot.

FIG. 3 illustrates an example in which an audio jack 200 of an external personal playback device is attached to the jack slot 110. For example, as illustrated in FIG. 3 the audio jack 200 having four poles is attached to the jack slot 110.

Referring to FIGS. 1 and 3, the jack slot 110 includes a body 111, a first channel electrode 112L, a second channel electrode 112R, a ground electrode 112G, a first channel detection electrode 113LD, a ground detection electrode 113GD, and a microphone detection electrode 113MD. The body 111 may be a case, a housing, a mold, or a frame of the audio device 100 or a system including the audio device 100.

When the audio jack 200 is attached to the jack slot 110, the first channel electrode 112L may send a first sound channel signal to a first pole 210 of the audio jack 200, and the second channel electrode 112R may send a second sound channel signal to a second pole 220 of the audio jack 200.

The ground electrode 112G is connected to a ground node to which a ground voltage in the detection and monitor unit 120 or the audio device 100 is supplied. The first channel detection electrode 113LD and the ground detection electrode 113GD are connected with an attachment detector 121 shown in FIG. 4. The detection and monitor unit 120 detects whether the audio jack 200 or a conductive material such as a conductive contaminant is attached to the jack slot 110, based on the first voltage V1 of the ground detection electrode 113GD and the second voltage V2 of the first channel detection electrode 113LD.

The microphone detection electrode 113MD is connected to the detection and monitor unit 120. If it is determined that a conductive material is not attached to or present in the jack slot 110, or that a conductive contaminant but not an audio jack is attached, the detection and monitor unit 120 transmits a ground voltage to the microphone detection electrode 113MD.

On the other hand, if it is determined that the audio jack 200 is attached to the jack slot 110, the detection and monitor unit 120 applies the third voltage V3 to the microphone detection electrode 113MD, and detects whether the audio jack 200 inserted into the jack slot 110 has a fourth pole 240 (i.e., microphone pole) based on a change in the third voltage V3.

If it is determined that the audio jack 200 inserted into the jack slot 110 does not have the fourth pole 240, the detection and monitor unit 120 transmits the ground voltage to the microphone detection electrode 113MD. If the audio jack 200 inserted into the jack slot 110 includes the fourth pole 240, the detection and monitor unit 120 constantly transmits the third voltage V3 to the microphone detection electrode 113MD. The third voltage V3 may be used as a bias voltage for an operation of a microphone.

In some embodiments, the audio jack 200 inserted into the jack slot 110 may include 4 poles. The first pole 210 may receive an audio signal of a first channel from the first channel electrode 112L, for example an audio signal of a left channel. The second pole 220 may receive an audio signal of a second channel from the second channel electrode 112R, for example an audio signal of a right channel. The third pole 230 may receive the ground voltage from the ground electrode 112G. The fourth pole 240 may receive the third voltage V3 through the microphone detection electrode 113MD.

The first pole 210 and the second pole 220 are electrically separated from each other by a first insulator 215. The second pole 220 and the third pole 230 are electrically separated from each other by a second insulator 225. The third pole 230 and the fourth pole 240 are electrically separated from each other by a third insulator 235.

Figure 4:
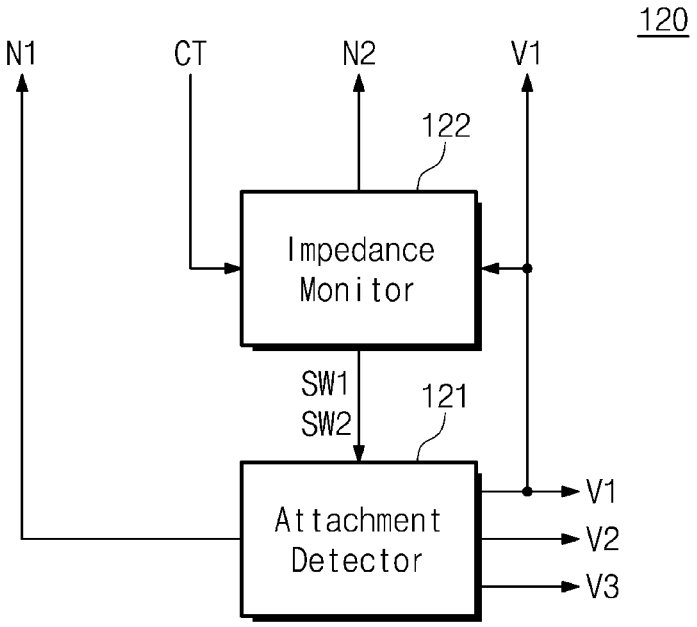
FIG. 4 illustrates a block diagram of detection and monitor unit according to an embodiment of the inventive concept.

FIG. 4 illustrates a block diagram of the detection and monitor unit 120 according to an embodiment of the inventive concept. Referring to FIGS. 1 to 3, the detection and monitor unit 120 includes the attachment detector 121 and an impedance monitor 122. The attachment detector 121 supplies the first to third voltages V1 to V3 to the jack slot 110.

For example, the first voltage V1 is transmitted to the ground detection electrode 113GD of the jack slot 110, and the second voltage V2 is transmitted to the first channel detection electrode 113LD of the jack slot 110. The third voltage V3 is transmitted to the microphone detection electrode 113MD of the jack slot 110.

The attachment detector 121 may receive first and second signals SW1 and SW2 from the impedance monitor 122. In response to the first and second signals SW1 and SW2, the attachment detector 121 supplies the first to third voltages V1 to V3 to the jack slot 110. For example, the attachment detector 121 may adjust timings to apply the first to third voltages V1 to V3, or timings to stop the applying of the first to third voltages V1 to V3, in response to the first and second signals SW1 and SW2.

The attachment detector 121 detects whether a conductive material is attached to or present in the jack slot 110, based on the first and second voltages V1 and V2. If it is detected that a conductive material is attached to the jack slot 110, the attachment detector 121 activates the first notification N1. The first notification N1 is transmitted to the determination unit 130.

The impedance monitor 122 may be controlled to enter one of the first detection mode and the second detection mode depending on the control signal CT. Immediately after power is supplied to the audio device 100, when a conductive material is not attached to or present in the jack slot 110, or when the audio jack 200 is attached to the jack slot 110, the impedance monitor 122 operates in the first detection mode. When a conductive material (e.g., a conductive contaminant) is attached to or present in the jack slot 110, the impedance monitor 122 operates in the second detection mode.

In the first detection mode, the impedance monitor 122 controls the first and second signals SW1 and SW2 such that the attachment detector 121 constantly supplies the first and second voltages V1 and V2 to the jack slot 110. In the second detection mode, the impedance monitor 122 controls the first and second signals SW1 and SW2 such that the attachment detector 121 periodically (or intermittently) supplies the first and second voltages V1 and V2 to the jack slot 110.

In the second detection mode, the impedance monitor 122 monitors the impedance between the ground detection electrode 113GD and the ground electrode 112G based on the first voltage V1. For example, since the attachment detector 121 applies the first voltage V1 periodically, the impedance monitor 122 may monitor impedance periodically.

In an embodiment, if a conductive material is attached between the ground detection electrode 113GD and the ground electrode 112G, the first voltage V1 of the ground detection electrode 113GD may decrease in response to the impedance of the conductive material. If the event that the first voltage V1 of the ground detection electrode 113GD changes during the periodic monitoring, the event means that the impedance between the ground detection electrode 113GD and the ground electrode 112G changes. A change of impedance represents that a conductive material is removed or that a conductive material is changed (e.g., that the audio jack 200 is attached).

When the first voltage V1 changes, that is, when the impedance between the ground detection electrode 113GD and the ground electrode 112G changes, the impedance monitor 122 activates the second notification N2 representing a change in impedance (or a change in voltage). The second notification N2 is transmitted to the determination unit 130.

Figure 5:
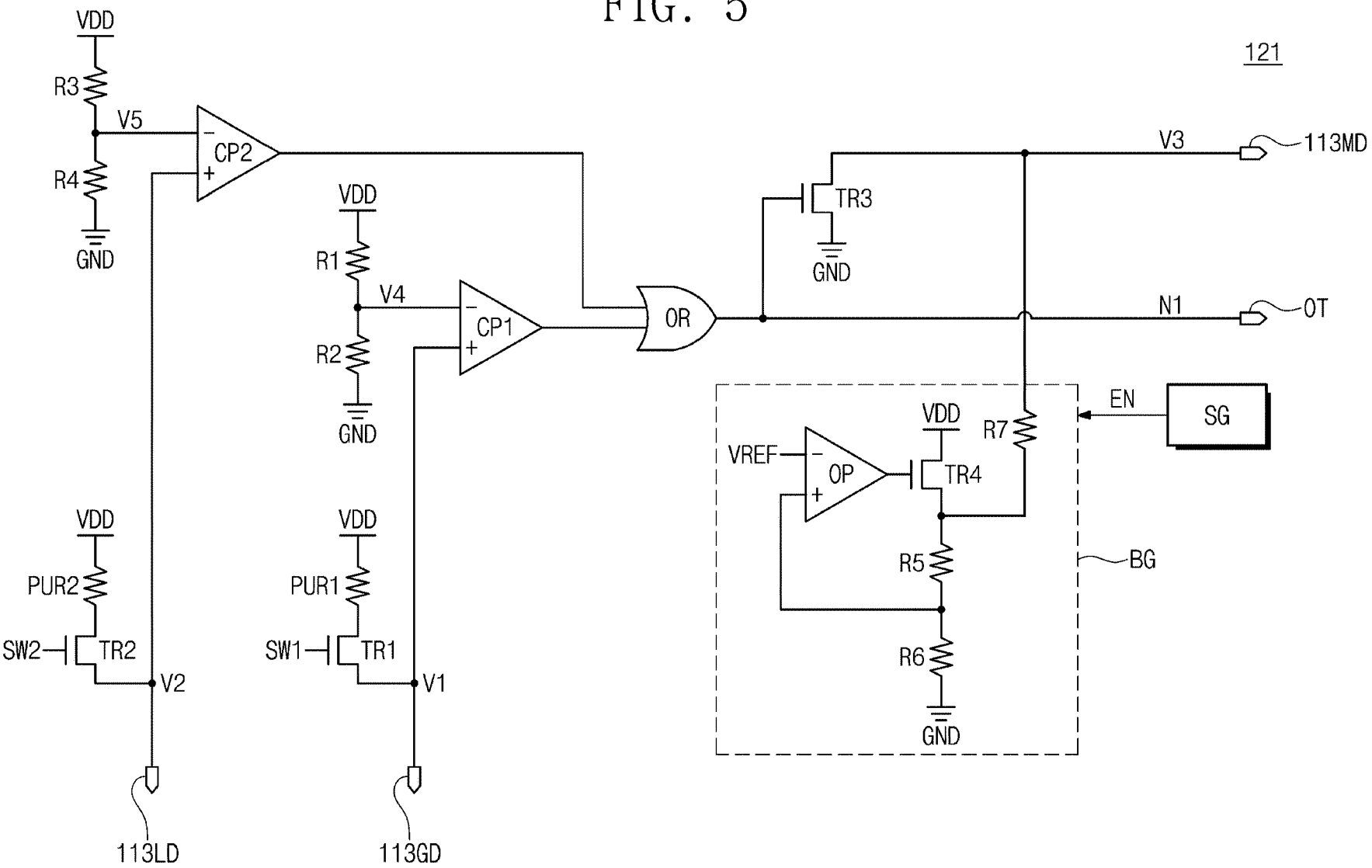
FIG. 5 illustrates a block diagram of an attachment detector according to an embodiment of the inventive concept.

FIG. 5 illustrates a block diagram of the attachment detector 121 according to an embodiment of the inventive concept. Referring to FIGS. 3 to 5, the attachment detector 121 includes first to fourth resistors R1 to R4, a first comparator CP1, a second comparator CP2, a first pull-up resistor PUR1, a logic gate circuit OR, a second pull-up resistor PUR2, first to third transistors TR1, TR2 and TR3, a signal generator SG, and a bias voltage generation circuit BG.

The first resistor R1 and the second resistor R2 are connected in series between a power node VDD supplied with a power supply voltage and a ground node GND supplied with a ground voltage. A voltage of a node between the first resistor R1 and the second resistor R2 may be a fourth voltage V4. For example, the first and second resistors R1 and R2 may have resistance values that are determined according to a division ratio designed to detect insertion of the audio jack 200.

For example, at least one of the first and second resistors R1 and R2 may have a variable resistance value. For example, the detection and monitor unit 120 may adjust the accuracy or sensitivity to detect the audio jack 200 by adjusting a resistance value of at least one of the first and second resistors R1 and R2.

The first pull-up resistor PUR1 and the first transistor TR1 are connected between the power node VDD and the ground detection electrode 113GD. The power supply voltage is transmitted to the ground detection electrode 113GD through the first pull-up resistor PUR1 and the first transistor TR1 as the first voltage V1. The first transistor TR1 may be controlled by the first signal SW1.

The first comparator CP1 is configured to compare the fourth voltage V4 and the first voltage V1 of the ground detection electrode 113GD. If the first voltage V1 of the ground detection electrode 113GD is not lower than the fourth voltage V4, the first comparator CP1 outputs a high level. If the first voltage V1 of the ground detection electrode 113GD is lower than the fourth voltage V4, the first comparator CP1 outputs a low level. An output of the first comparator CP1 is transmitted to the logic gate circuit OR.

The third resistor R3 and the fourth resistor R4 are connected in series between the power node VDD supplied with a power supply voltage and the ground node GND supplied with a ground voltage. A voltage of a node between the third resistor R3 and the fourth resistor R4 may be a fifth voltage V5. For example, the third and fourth resistors R3 and R4 may have resistance values that are determined according to a division ratio designed to detect insertion of the audio jack 200.

For example, at least one of the third and fourth resistors R3 and R4 may have a variable resistance value. For example, the detection and monitor unit 120 may adjust the accuracy or sensitivity to detect the audio jack 200 by adjusting a resistance value of at least one of the third and fourth resistors R3 and R4.

The second pull-up resistor PUR2 and the second transistor TR2 are connected between the power node VDD and the first channel detection electrode 113LD. The power supply voltage is transmitted to the first channel detection electrode 113LD through the second pull-up resistor PUR2 and the second transistor TR2 as the second voltage V2. The second transistor TR2 may be controlled by the second signal SW2.

The second comparator CP2 is configured to compare the fifth voltage V5 and the second voltage V2 of the first channel detection electrode 113LD. If the second voltage V2 of the first channel detection electrode 113LD is not lower than the fifth voltage V5, the second comparator CP2 outputs a high level. If the second voltage V2 of the first channel detection electrode 113LD is lower than the fifth voltage V5, the second comparator CP2 outputs a low level. An output of the second comparator CP2 is transmitted to the logic gate circuit OR.

In an embodiment, at least one of the first and second pull-up resistors PUR1 and PUR2 may have a variable resistance value. For example, when a conductive material is not attached to or present in the jack slot 110, when a conductive contaminant is attached to or present in the jack slot 110, or when the audio jack is attached to the jack slot 110, the detection and monitor unit 120 may adjust (e.g., increase or decrease) a resistance value of at least one of the first and second pull-up resistors PUR1 and PUR2.

The logic gate circuit OR performs an OR operation based on the output of the first comparator CP1 and the output of the second comparator CP2. An output of the logic gate circuit OR is transmitted to the determination unit 130 through an output terminal OT as the first notification N1. The first notification N1 may be used to control the third transistor TR3 and may be used to control the signal generator SG.

In an embodiment, when the first channel detection electrode 113LD and the first channel electrode 112L are coupled to each other by a conductive material, and the ground detection electrode 113GD and the ground electrode 112G are coupled to each other by a conductive material, the outputs of the first and second comparators CP1 and CP2 are low levels.

Accordingly, when the output of the logic gate circuit OR (i.e., the first notification N1) is a low level, the first notification N1 may represent that a conductive material is attached to or present in the jack slot 110. When at least one of the output of the second comparator CP2 and the second voltage V2 is a high level, the first notification N1 may be a high level representing that a conductive material is not attached to or present in the jack slot 110.

The third transistor TR3 is connected between the microphone detection electrode 113MD and the ground node GND supplied with the ground voltage, and is controlled by the first notification N1. When the first notification N1 is a high level, that is when a conductive material is not attached to or present in the jack slot 110, the third transistor TR3 connects the ground node and the microphone detection electrode 113MD. That is, the ground voltage is supplied to the microphone detection electrode 113MD. When the first notification N1 is a low level, that is when a conductive material is attached to or present in the jack slot 110, the third transistor TR3 is turned off. That is, a voltage of the microphone detection electrode 113MD is controlled by the bias voltage generation circuit BG.

The signal generator SG outputs an enable signal EN. For example, when the first notification N1 is a high level, that is when a conductive material is not attached to or present in the jack slot 110, the signal generator SG deactivates the enable signal EN. When the first notification N1 is a low level, that is when a conductive material is attached to or present in the jack slot 110, the signal generator SG activates the enable signal EN.

When the enable signal EN is activated, the bias voltage generation circuit BG supplies the third voltage V3 to the microphone detection electrode 113MD. When the enable signal EN is deactivated, the bias voltage generation circuit BG is deactivated and does not output the third voltage V3. For example, the bias voltage generation circuit BG may output the ground voltage.

The bias voltage generation circuit BG includes an operational amplifier OP, a fourth transistor TR4, a fifth resistor R5, a sixth resistor R6, and a seventh resistor R7. The fifth resistor R5 and the sixth resistor R6 are connected in series between the fourth transistor TR4 and the ground node GND supplied with the ground voltage. A node between the fifth resistor R5 and the sixth resistor R6 is connected to a positive input of the operational amplifier OP. A reference voltage VREF is input to a negative input of the operational amplifier OP.

The fourth transistor TR4 is connected between the power node supplied with the power supply voltage VDD and the fifth resistor R5. The fourth transistor TR4 is controlled according to an output of the operational amplifier OP. A voltage of a node between the fourth transistor TR4 and the fifth resistor R5 is transmitted to the microphone detection electrode 113MD through the seventh resistor R7 as the third voltage V3. The bias voltage generation circuit BG may adjust the third voltage V3 such that a voltage of the node between the fifth resistor R5 and the sixth resistor R6 coincides with the reference voltage VREF.

As described with reference to FIG. 5, the attachment detector 121 may supply the first and second voltages V1 and V2 to the jack slot 110 in response to the first and second signals SW1 and SW2. The attachment detector 121 may detect that a conductive material is attached to the jack slot 110, based on changes in the first and second voltages V1 and V2.

The attachment detector 121 may supply the third voltage V3 to the jack slot 110 in response to detecting attachment of a conductive material to the jack slot 110. The third voltage V3 may be used to determine whether the audio jack 200 has the fourth pole 240 for a microphone.

Figure 6:
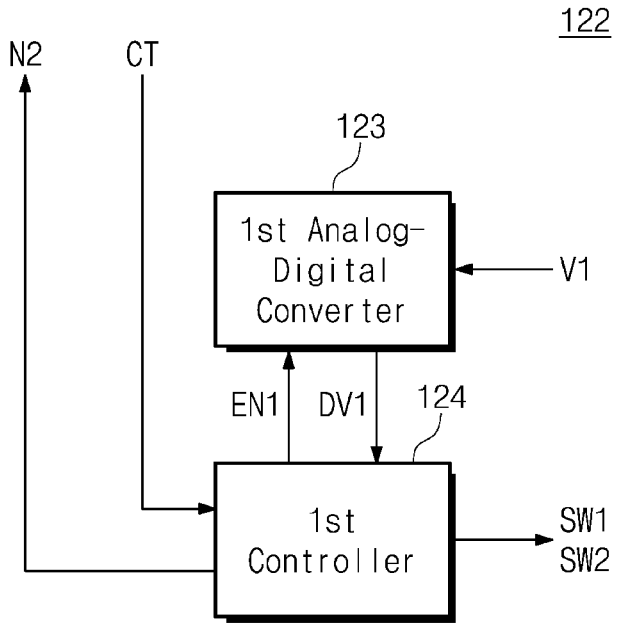
FIG. 6 illustrates a block diagram of an example of an impedance monitor.

FIG. 6 illustrates a block diagram of an example of the impedance monitor 122. Referring to FIGS. 4 to 6, the impedance monitor 122 includes a first analog-to-digital converter 123 and a first controller 124. The first analog-to-digital converter 123 digitizes the first voltage V1 to a first digital voltage DV1 in response to a first enable signal EN1. The first digital voltage DV1 may have a digital value that is expressed by bits, the number of which may be specified.

The first controller 124 adjusts the first and second signals SW1 and SW2 and the first enable signal EN1 in response to the control signal CT. For example, the first controller 124 may be controlled to enter one of the first detection mode and the second detection mode in response to the control signal CT.

In the first detection mode, the first controller 124 controls the first and second signals SW1 and SW2 such that the first and second transistors TR1 and TR2 are always turned on. Also, in the first detection mode, the first controller 124 deactivates the first enable signal EN1 such that the first analog-to-digital converter 123 does not convert the first voltage V1 to the first digital voltage DV1.

In the second detection mode, the first controller 124 periodically controls the first and second signals SW1 and SW2 such that the first and second transistors TR1 and TR2 are turned off during a first time interval, and periodically controls the first and second signals SW1 and SW2 such that the first and second transistors TR1 and TR2 are turned on during a second time interval. For example, the first and second signals SW1 and SW2 may be controlled to have a low level during the first time interval to turn the first and second transistors TR1 and TR2 off, and to have a high level during the second time interval to turn the first and second transistors TR1 and TR2 on.

The first controller 124 provides the first and second signals SW1 and SW2 to have a low level and a high level periodically. For example, in some embodiments the first time interval in which the first and second signals SW1 and SW2 have a low level may be longer than the second time interval in which the first and second signals SW1 and SW2 have a high level.

Also, in the second detection mode, the first controller 124 activates the first enable signal EN1 such that the first analog-to-digital converter 123 converts the first voltage V1 to the first digital voltage DV1. For example, the first controller 124 may activate the first enable signal EN1 during the first time interval in which the first and second signals SW1 and SW2 turn on the first and second transistors TR1 and TR2.

In the second detection mode, the first controller 124 monitors a value of the first digital voltage DV1. For example, when the value of the first digital voltage DV1 is maintained uniformly, the first controller 124 may deactivate the second notification N2. If the value of the first digital voltage DV1 changes from a previous value, the first controller 124 may activate the second notification N2.

To sum up, in the first detection mode, the impedance monitor 122 controls the first and second signals SW1 and SW2 such that the attachment detector 121 constantly monitors to detect whether a conductive material is attached to the jack slot 110. In the second detection mode, the impedance monitor 122 controls the first and second signals SW1 and SW2 such that the attachment detector 121 periodically (or intermittently) monitors to detect whether a conductive material is attached to the jack slot 110.

In the second detection mode, while the attachment detector 121 detects whether a conductive material is attached, the impedance monitor 122 may monitor a change in impedance of the conductive material attached to the jack slot 110 by monitoring a change in the first voltage V1. If a change in the impedance of the conductive material is not smaller than a threshold value, the impedance monitor 122 may output the second notification N2 representing a change in impedance.

In FIG. 6, the first analog-to-digital converter 123 is described as converting the first voltage V1 to the first digital voltage DV1. However, the inventive concept is not limited to converting the first voltage V1, and in other embodiments the first analog-to-digital converter 123 may for example convert the second voltage V2 to provide the first digital voltage DV1.

Also, in other embodiments the first analog-to-digital converter 123 may convert the first and second voltages V1 and V2 to respective digital voltages. The first controller 124 may monitor changes in digital voltages and may activate the second notification N2 when a change or changes of the threshold value or more occur.

Figure 7:
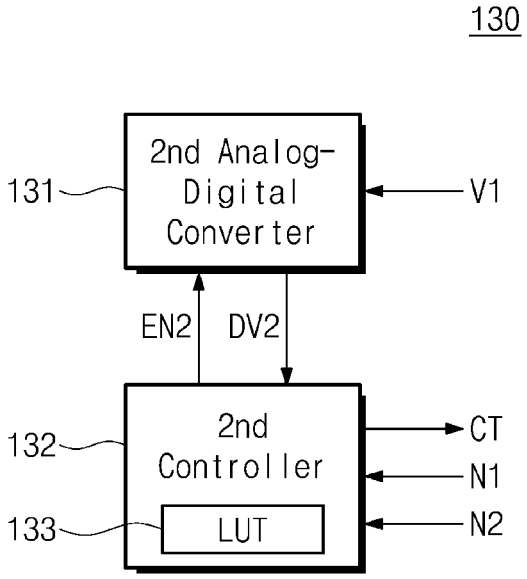
FIG. 7 illustrates a block diagram of an example of determination unit according to an embodiment of the inventive concept.

FIG. 7 illustrates a block diagram of an example of the determination unit 130 according to an embodiment of the inventive concept. Referring to FIGS. 1 and 7, the determination unit 130 includes a second analog-to-digital converter 131 and a second controller 132. The second analog-to-digital converter 131 may be activated in response to a second enable signal EN2.

When activated, the second analog-to-digital converter 131 converts the first voltage V1 to a second digital voltage DV2. The second digital voltage DV2 may have a digital value that is expressed by bits, the number of which may be specified. The number of bits of the second digital voltage DV2 is more than the number of bits of the first digital voltage DV1 (refer to FIG. 6). That is, the resolution of the second analog-to-digital converter 131 is higher than the resolution of the first analog-to-digital converter 123.

The second controller 132 may receive the first and second notifications N1 and N2 from the detection and monitor unit 120. The second controller 132 allows or directs the detection and monitor unit 120 to operate in one of the first detection mode and the second detection mode by using the control signal CT. For example, as a default setting (or an initial setting), the second controller 132 may control the detection and monitor unit 120 so as to operate in the first detection mode.

In the first detection mode, the second controller 132 monitors whether the first notification N1 is received (or activated). If the first notification N1 is received, the second controller 132 activates the second enable signal EN2 such that the second analog-to-digital converter 131 converts the first voltage V1 to the second digital voltage DV2.

The second controller 132 compares a value of the second digital voltage DV2 with values in a look-up table (LUT) 133. For example, the look-up table 133 may include information about a value (or range) of the second digital voltage DV2 (which corresponds to the first voltage V1) when the audio jack 200 is attached to the jack slot 110.

The second controller 132 may determine whether a value of the second digital voltage DV2 (and thus the first voltage V1) is a value (or range) (hereinafter referred to as a "true value") of the look-up table 133 corresponding to the case where the audio jack 200 is inserted in the jack slot 110. If the value of the second digital voltage DV2 corresponds to the true value, the second controller 132 determines that the audio jack 200 is attached to the jack slot 110. Afterwards, the second controller 132 allows or directs the detection and monitor unit 120 to operate in the first detection mode such that the detection and monitor unit 120 detects detachment of the audio jack 200.

If a value of the second digital voltage DV2 is a value (or range) (hereinafter referred to as a "false value") of the look-up table 133 corresponding to the case where the audio jack 200 is not inserted, the second controller 132 determines that a conductive material (e.g., a conductive contaminant) and not the audio jack 200 is attached to the jack slot 110. Afterwards, the second controller 132 directs the detection and monitor unit 120 to enter the second detection mode by using the control signal CT. In the second detection mode, the detection and monitor unit 120 prevents (or suppresses) corrosion of the jack slot 110 and detects attachment of the audio jack 200.

In the second detection mode, the second controller 132 monitors whether the second notification N2 is received (or activated). If the second notification N2 is received, the second controller 132 activates the second enable signal EN2 such that the second analog-to-digital converter 131 converts the first voltage V1 to the second digital voltage DV2.

In the second detection mode, if the second digital voltage DV2 corresponds to the true value, the second controller 132 determines that the audio jack 200 is attached to the jack slot 110. The second controller 132 allows or directs the detection and monitor unit 120 to enter the first detection mode by using the control signal CT. In the first detection mode, the detection and monitor unit 120 detects detachment of the audio jack 200.

In the second detection mode, if the second digital voltage DV2 corresponds to the false value, the second controller 132 determines that a conductive contaminant is attached to the jack slot 110. Afterwards, the second controller 132 allows or directs the detection and monitor unit 120 to enter the second detection mode. In the second detection mode, the detection and monitor unit 120 prevents (or suppresses) corrosion of the jack slot 110 and detects attachment of the audio jack 200.

In an embodiment of the inventive concept, the determination unit 130 may output a first signal representing attachment of the audio jack 200 to an external device in response to the event that the attachment of the audio jack 200 is determined. The determination unit 130 may output a second signal representing attachment of a conductive contaminant to the external device in response to the event that the attachment of the conductive contaminant is determined.

For example, the look-up table 133 may include information about values (or ranges) of the second digital voltage DV2 which correspond to various conductive contaminants. In response to the event that a value of the second digital voltage DV2 is determined as one of values (or ranges) of conductive contaminants, the second controller 132 may output, to the external device, a third signal representing that a conductive contaminant is attached to the jack slot 110 and a kind of the conductive contaminant attached.

In FIG. 7, the second analog-to-digital converter 131 is described as converting the first voltage V1 to the second digital voltage DV2. However, the inventive concept is not limited to converting the first voltage V1, and in other embodiments the second analog-to-digital converter 131 may for example convert the second voltage V2 to provide the second digital voltage DV2.

Also, in other embodiments the second analog-to-digital converter 131 may convert the first and second voltages V1 and V2 to respective digital voltages. The second controller 132 may compare the digital voltages with values (or ranges) in the look-up table 133 and may determine a kind of the conductive material attached to the jack slot 110 depending on the comparison result.

For example, the second controller 132 may compare the digital voltages with values in respective different look-up tables. The second controller 132 may calculate or determine an average, an intermediate value, a maximum value, or a minimum value of the respective digital voltages, and compare the result with values of the look-up table 133. The second controller 132 may select one of the digital voltages and may compare the selected digital voltage with values of the look-up table 133.

Figure 8:
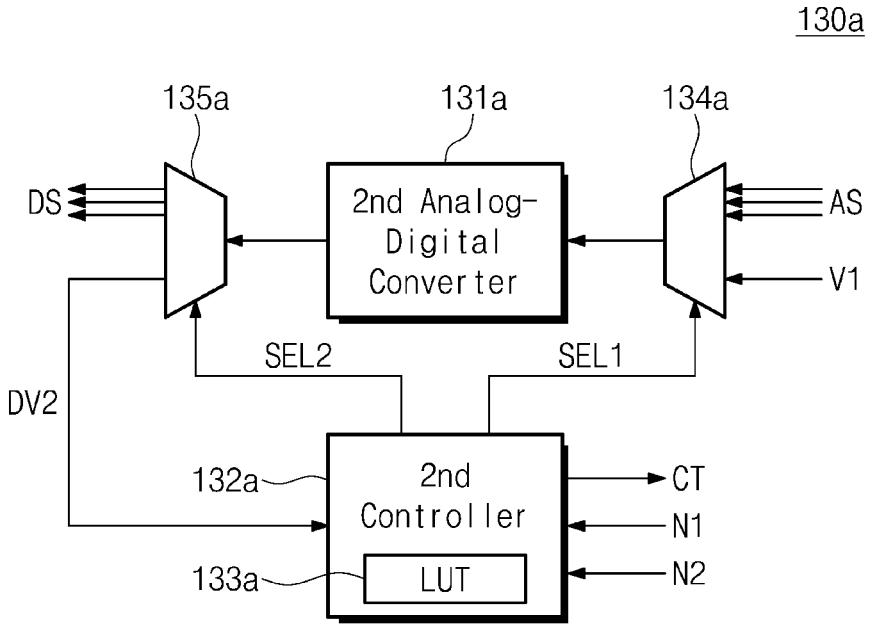
FIG. 8 illustrates a block diagram of determination unit according to another embodiment of the inventive concept.

FIG. 8 illustrates a block diagram of determination unit 130*a* according to another embodiment of the inventive concept. Referring to FIGS. 1 and 8, determination unit 130*a* includes a second analog-to-digital converter 131*a*, a second controller 132*a*, a multiplexer 134*a*, and a demultiplexer 135*a*. The second controller 132*a* includes a look-up table 133*a*.

Compared with FIG. 7, the determination unit 130*a* further includes the multiplexer 134*a* and the demultiplexer 135*a*. For example, the second analog-to-digital converter 131*a* may be used by any other device as well as the second controller 132*a*. That is, the second analog-to-digital converter 131*a* may be shared by a plurality of devices.

The multiplexer 134*a* may receive analog signals AS from other devices, as well as the first voltage V1. The demultiplexer 135*a* may output digital signals DS to other devices, as well as the second digital voltage DV2. When the second analog-to-digital converter 131*a* is used by other devices, the multiplexer 134*a* may output one of the analog signals AS to the second analog-to-digital converter 131*a*.

When the second analog-to-digital converter 131*a* is used by other devices, the demultiplexer 135*a* may output one of the digital signals DS to any other device. When the second analog-to-digital converter 131*a* is used by the second controller 132*a*, the second controller 132*a* activates a first selection signal SEL1 and a second selection signal SEL2.

The multiplexer 134*a* outputs the first voltage V1 to the second analog-to-digital converter 131*a* in response to activation of the first selection signal SEL1. The demultiplexer 135*a* provides the second digital voltage DV2 from the second analog-to-digital converter 131*a* to the second controller 132*a* in response to activation of the second selection signal SEL2.

Figure 9:
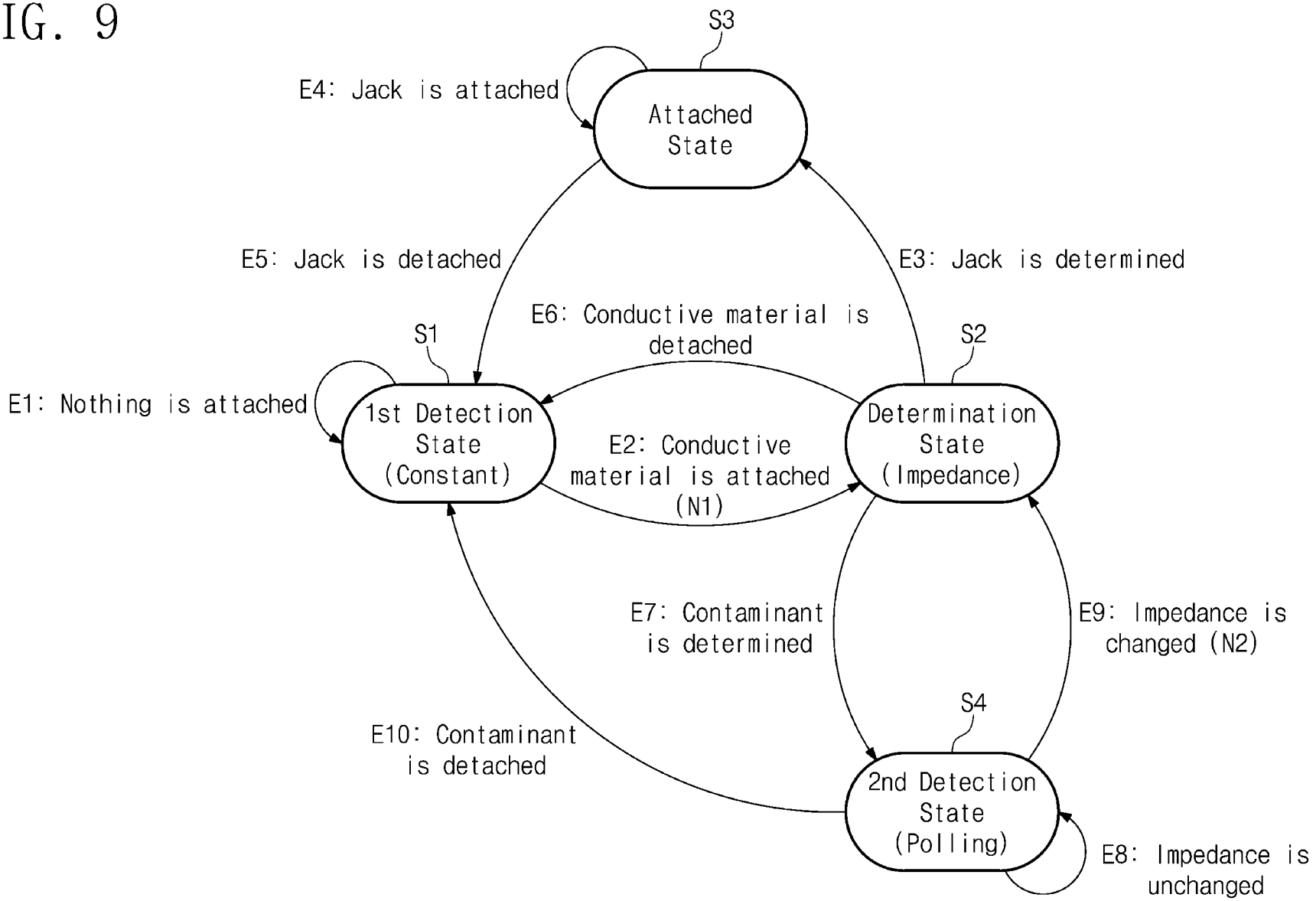
FIG. 9 illustrates a state diagram of an example of an operating method of the audio device according to an embodiment of the inventive concept.

FIG. 9 illustrates a state diagram of an example of an operating method of the audio device 100 according to an embodiment of the inventive concept. Referring to FIGS. 1 and 9, a default state (or an initial state) may be a first state S1. In the first state S1, the audio device 100 has a first detection state. The first detection state corresponds to the first detection mode.

In the first state S1, the audio device 100 detects whether a conductive material is attached to the jack slot 110, in a state where the first voltage V1 and the second voltage V2 are constantly applied to the ground detection electrode 113GD (refer to FIG. 5) and the first channel detection electrode 113LD, respectively. For example, the first controller 124 (refer to FIG. 6) provides the first and second signals SW1 and SW2 as maintaining a high level.

In the first state S1, when a first event E1 occurs whereby it is determined that nothing is attached to jack slot 110 (e.g., no conductive material is attached to the jack slot 110), the audio device 100 maintains the first state S1. In the first state S1, when a second event E2 occurs whereby it is determined that a conductive material is attached to or present in the jack slot 110, the audio device 100 enters a second state S2.

For example, when the first voltage V1 is lower than the fourth voltage V4 (refer to FIG. 5) and/or the second voltage V2 is lower than the fifth voltage V5, the audio device 100 detects that a conductive material is attached to the jack slot 110 (i.e., detects the second event E2). The attachment detector 121 then activates the first notification N1 (refer to FIG. 4) and the audio device 100 enters the second state S2.

The second state S2 is a determination state. For example, in response to the first notification N1 or the second notification N2, the determination unit 130 determines impedance of the conductive material connected between the ground detection electrode 113GD and the ground electrode 112G. For example, the determination unit 130 compares a level of the first voltage V1 with values in the look-up table 133 and determines a kind of the conductive material attached to the jack slot 110 depending on the comparison result.

In the second state S2, when a third event E3 occurs whereby it is determined that the audio jack 200 is attached to the jack slot 110, the audio device 100 enters a third state S3. The third state S3 is an attached state. In the third state S3, the audio device 100 detects whether the audio jack 200 is detached from the jack slot 110.

For example, as in the first detection state S1, the audio device 100 detects whether the previously attached audio jack 200 is detached from the jack slot 110 in a state where the first voltage V1 and the second voltage V2 are constantly applied to the ground detection electrode 113GD (refer to FIG. 5) and the first channel detection electrode 113LD, respectively.

For example, when entering the third state S3, the audio device 100 may adjust a resistance value of at least one of the first and second pull-up resistors PUR1 and PUR2 (refer to FIG. 5). For example, the audio device 100 may adjust resistance values of the first and second pull-up resistors PUR1 and PUR2 so as to be suitable to detect detachment of the audio jack 200.

In the third state S3, when the fourth event E4 occurs whereby it is determined that the audio jack 200 is constantly attached to the jack slot 110, the audio device 100 maintains the third state S3. When a fifth event E5 occurs where it is determined that the audio jack 200 is detached from the jack slot 110, the audio device 100 enters the first state S1.

For example, when entering the first state S1, the audio device 100 may adjust a resistance value of at least one of the first and second pull-up resistors PUR1 and PUR2. For example, the audio device 100 may adjust resistance values of the first and second pull-up resistors PUR1 and PUR2 so as to be suitable to detect attachment of the audio jack 200 or a conductive material.

Returning to the second state S2, when a sixth event E6 occurs whereby it is determined that the conductive material that was attached to the jack slot 110 is (or becomes) detached, the audio device 100 enters the first state S1. For example, when a user removes the conductive material attached to or present in the jack slot 110 (e.g., through cleaning), the conductive material may be removed from the jack slot 110. In the first state S1, the audio device 100 detects whether any other conductive material is attached.

In the second state S2, when a seventh event E7 occurs whereby it is determined that a conductive contaminant and not the audio jack 200 is attached to the jack slot 110, the audio device 100 enters a fourth state S4. The fourth state S4 corresponds to the second detection mode.

For example, when a value of the second digital voltage DV2 (refer to FIG. 7) does not correspond to a value (or a value range) of the audio jack 200 recorded in the look-up table 133, the second controller 132 controls the control signal CT such that the detection and monitor unit 120 enters the second detection mode corresponding to the fourth state S4.

In the fourth state S4, the detection and monitor unit 120 may operate during a first time interval in which the first to third voltages V1 to V3 are not applied to the jack slot 110, and during a second time interval in which the first and second voltages V1 and V2 are applied to the jack slot 110. That is, the detection and monitor unit 120 periodically polls a value of the first voltage V1 from the jack slot 110. That is, the fourth state S4 includes periodically polling the first voltage V1

In the fourth state S4, when an eighth event E8 occurs whereby it is determined that impedance of the conductive material does not change, the audio device 100 maintains the fourth state S4. For example, the detection and monitor unit 120 monitors whether the impedance changes, by monitoring a change in the first voltage V1 by using the first analog-to-digital converter 123 (refer to FIG. 6).

In the fourth state S4, when a ninth event E9 occurs whereby it is determined that impedance of the conductive material changes, the audio device 100 enters the second state S2. In the second state S2, the audio device 100 again determines whether the conductive material attached to the jack slot 110 is the audio jack 200 or a contaminant.

In the fourth state S4, when a tenth event E10 occurs whereby it is determined that the contaminant attached to the jack slot 110 is detached, the audio device 100 enters the first state S1. For example, if the user removes the contaminant attached to or present in the jack slot 110 through cleaning, the first notification N1 is deactivated. If the first notification N1 is deactivated, the audio device 100 enters the first state S1. In the first state S1, the audio device 100 detects whether any other conductive material is attached to the jack slot 110.

As described above, when a conductive contaminant and not the audio jack 200 is attached to the jack slot 110, the audio device 100 may stop applying voltages constantly and may apply voltages periodically (or intermittently) to monitor whether the audio jack 200 is attached. Accordingly, the lifespan of the audio device 100 may be improved because detection of the audio jack 200 is enabled while preventing (or suppressing) corrosion of the jack slot 110.

Also, the audio device 100 uses the second analog-to-digital converter 131 to determine a kind of a conductive material attached to the jack slot 110 and uses the first analog-to-digital converter 123 to monitor a change in impedance of the conductive material. The resolution of the second analog-to-digital converter 131 is higher than the resolution of the first analog-to-digital converter 123.

Due to a difference between the resolutions, power consumption of the second analog-to-digital converter 131 is greater than power consumption of the first analog-to-digital converter 123. The audio device 100 according to an embodiment of the inventive concept uses the first analog-to-digital converter 123 of low power to monitor a change in impedance and uses the second analog-to-digital converter 131 of high performance to determine a kind of a conductive material. Accordingly, the audio device 100 may reduce power consumption for monitoring while securing the reliability of determination.

In the embodiment as described with respect to FIG. 9, the audio device 100 maintains the fourth state S4 when the eighth event E8 occurs in the fourth state S4. However, in some embodiments, when the eighth event E8 occurs the audio device 100 may adjust a detection period in addition to maintaining the fourth state S4. For example, if the impedance does not change by as much as a preset count (or amount), the audio device 100 may increase the detection period.

When a state of the audio device 100 is changed from the fourth state S4 to the first state S1 or the second state S2, the detection period may be initialized. As another example, when a state of the audio device 100 is changed from the fourth state S4 to the second state S2, the detection period may be maintained without initialization. The detection period may be initialized only when a state of the audio device 100 is changed from the fourth state S4 or the second state S2 to the first state S1 or the third state S3.

In an embodiment, when the eighth event E8 occurs, the audio device 100 may adjust a resistance value of at least one of the first to fourth resistors R1 to R4 (refer to FIG. 5). For example, the audio device 100 may make the reliability to detect attachment of the audio jack 200 high by adjusting a resistance value of at least one of the first to fourth resistors R1 to R4. Even though the audio jack 200 is attached, the audio device 100 may verify whether the seventh event E7 is determined.

Figure 10:
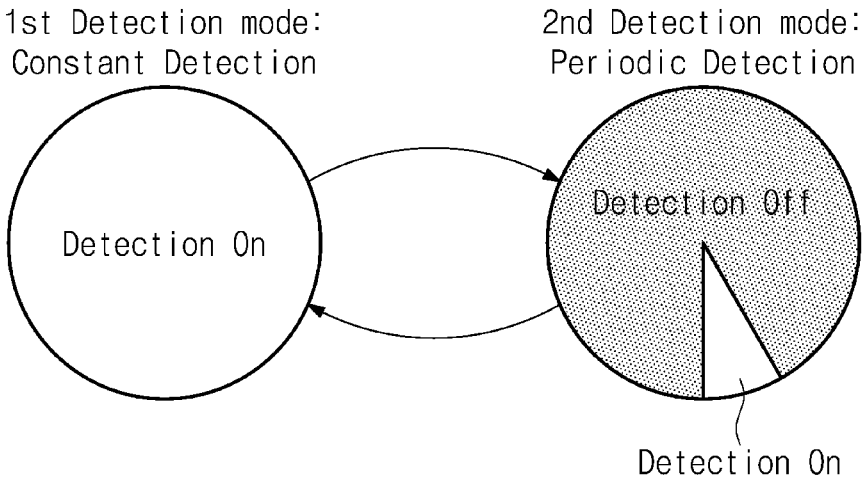
FIG. 10 illustrates an example in which detection is made in a first detection mode and a second detection mode.

FIG. 10 illustrates an example in which detection is made in a first detection mode and a second detection mode. Referring to FIGS. 1 and 10, detection is constant in the first detection mode. For example, during one operation cycle, the audio device 100 constantly monitors to detect (i.e., Detection On) whether a conductive material is attached to or present in the jack slot 110.

In the second detection mode, detection is periodic (or intermittent). For example, during one operation cycle, the audio device 100 performs monitoring to detect (i.e., Detection On) only during a time corresponding to a part of the operation cycle. During the remaining time of the operation cycle, the audio device 100 does not perform monitoring to detect (i.e., Detection Off). The audio device 100 may repeat the operation cycle to detect the audio jack 200 periodically.

Figure 11:
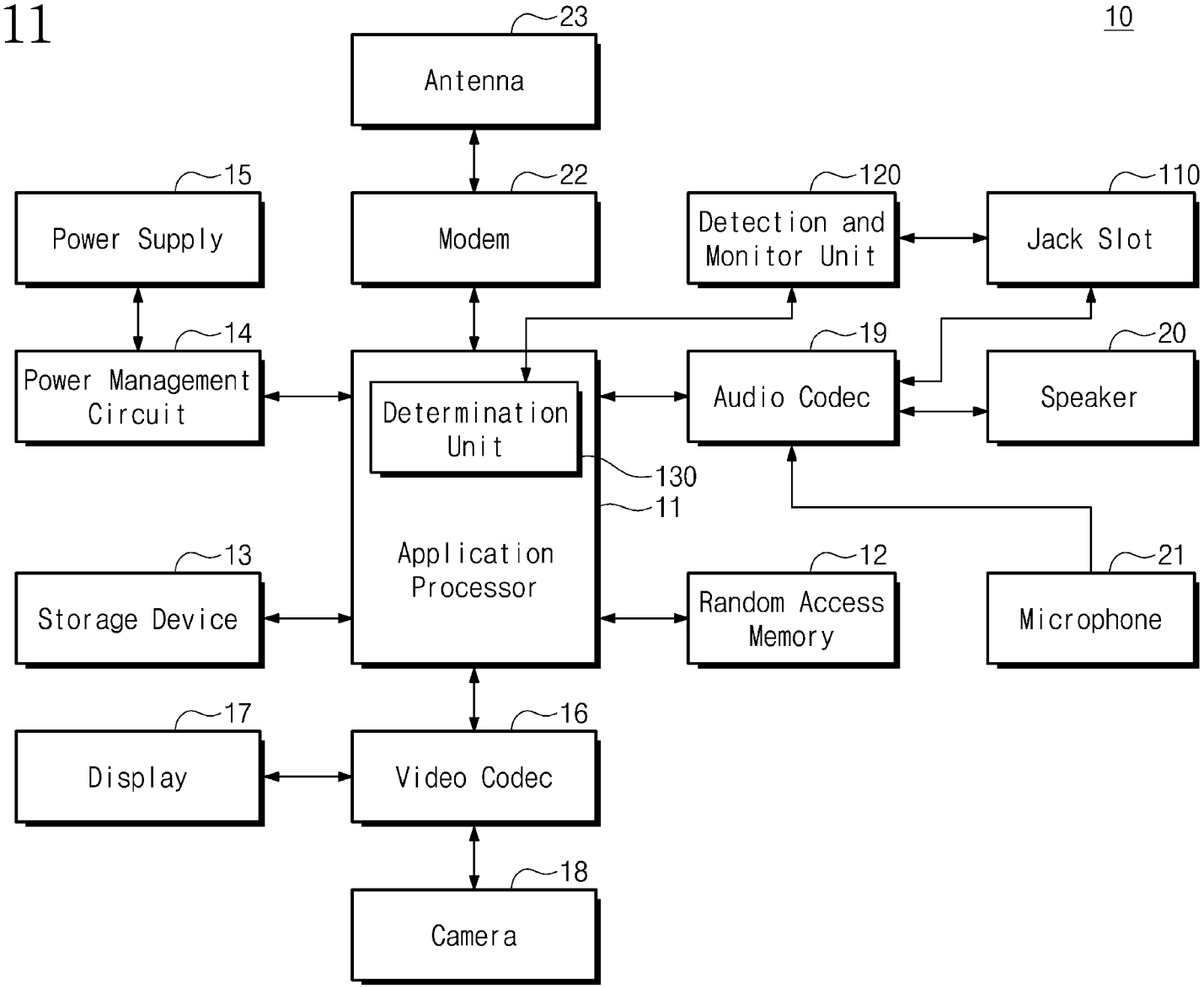
FIG. 11 illustrates a block diagram of an example of a multimedia device including the audio device according to an embodiment of the inventive concept.

FIG. 11 illustrates a block diagram of an example of a multimedia device including the audio device 100 according to an embodiment of the inventive concept. For example, a multimedia device 10 may form at least one of a smartphone, a smart pad, a smart television, a smart watch, and a wearable device, among other suitable devices.

Referring to FIGS. 1 and 11, the multimedia device 10 includes an application processor 11, a random access memory 12, a storage device 13, a power management circuit 14, a power supply 15, a video codec 16, a display 17, a camera 18, an audio codec 19, a speaker 20, a microphone 21, a modem 22, an antenna 23, the jack slot 110, and the detection and monitor unit 120. The application processor 11 includes the determination unit 130. The jack slot 110, the detection and monitor unit 120, and the determination unit 130 in FIG. 11 may be configured and function similarly as described with respect to FIGS. 1-10. Description of such similar configuration and function may be omitted from the following.

The application processor 11 may perform a control operation to control the multimedia device 10 and a processing operation to process a variety of data. The application processor 11 may execute an operating system and various applications. The application processor 11 may include the determination unit 130.

The second analog-to-digital converter 131 of the determination unit 130 (see FIG. 7) may be shared to convert various analog signals to digital signals within the application processor 11. For example, if it is determined that the audio jack 200 is attached to the jack slot 110, the determination unit 130 may inform the audio codec 19 of the attachment of the audio jack 200.

The random access memory 12 may be used as a main memory of the application processor 11. For example, the random access memory 12 may store a variety of data and process codes to be processed by the application processor 11. The random access memory 12 may include for example dynamic random access memory (DRAM), static RAM (SRAM), phase change RAM (PRAM), magnetic RAM (MRAM), a ferroelectric RAM (FRAM), resistive RAM (RRAM), and the like.

The storage device 13 may be used as an auxiliary memory of the application processor 11. For example, source codes of various applications or an operating system executable by the application processor 11 and a variety of data generated by the operating system or applications for long-term storage may be stored in the storage device 13. The storage device 13 may include for example flash memory, PRAM, MRAM, FRAM, RRAM, and the like.

The power management circuit 14 may distribute or supply power from the power supply 15 to components of the multimedia device 10. The power management circuit 14 may adjust the amount of power to be distributed or supplied to components of the multimedia device 10 depending on a state of the multimedia device 10 or the amount of tasks to be performed by the multimedia device 10. For example, the power management circuit 14 may control a power saving mode of the multimedia device 10 or each component of the multimedia device 10.

The power supply 15 may include a power supply installed in an artificial structure such as building or a portable battery. The video codec 16 may create or play video data. For example, the video codec 16 may encode data obtained by the camera 18 to create video data.

The video codec 16 may decode video data created by the camera 18 or video data stored in the storage device 13 or the random access memory 12 to play the video data through the display 17. For example, the display 17 may include a liquid crystal display (LCD), an organic light-emitting diode (OLED) display, an active matrix OLED (AMOLED) display, a flexible display, an electronic ink, among other display types.

The audio codec 19 may create or store audio data. For example, the audio codec 19 may encode data obtained by the microphone 21 to create audio data. The audio codec 19 may decode audio data created by the microphone 21 or audio data stored in the storage device 13 or the random access memory 12 to play the audio data through the speaker 20.

The audio codec 19 is connected with the jack slot 110. If a signal representing attachment of the audio jack 200 is received from the application processor 11, the audio codec 19 may output audio signals to the audio jack 200. For example, the audio codec 19 may supply audio signals to the first and second channel electrodes 112L and 112R (refer to FIG. 3), respectively.

The detection and monitor unit 120 may detect whether a conductive material is attached to the audio jack 200. If it is detected that the conductive material is attached to the jack slot 110, the detection and monitor unit 120 may transmit the first notification N1 to the determination unit 130 of the application processor 11. Also, the detection and monitor unit 120 may monitor a change of the conductive material attached to the jack slot 110. If the change of the conductive material is detected, the detection and monitor unit 120 may transmit the second notification N2 to the determination unit 130.

The modem 22 may communicate with an external device through the antenna 23. For example, the modem 22 may communicate with an external device based on at least one of wireless communication such as for example long term evolution (LTE), WiMax, global system for mobile communication (GSM), code division multiple access (CDMA), Bluetooth, near field communication (NFC), Wi-Fi, radio frequency identification (RFID) and the like, or wired communication such as for example universal serial bus (USB), serial AT attachment (SATA), high speed interchip (HSIC), Small Computer System Interface (SCSI), Firewire, peripheral component interconnection (PCI), PCI express (PCIe), nonvolatile memory express (NVMe), universal flash storage (UFS), secure digital (SD), SDIO, universal asynchronous receiver transmitter (UART), serial peripheral interface (SPI), high speed SPI (HS-SPI), RS232, inter-integrated circuit (I2C), HS-I2C, integrated-interchip sound (I2S), Sony/Philips digital interface (S/PDIF), multimedia card (MMC), embedded MMC (eMMC) and the like.

In an embodiment of the inventive concepts, at least the random access memory 12, the storage device 13 and the modem 22 may be characterized as a peripheral circuit. The peripheral circuit may include other units/devices. The application processor 11 may control the peripheral circuit. For example, when the application processor 11 receives from the detection and monitor unit 120 a notification representing attachment of the conductive material to the jack slot 110, the application processor 11 (i.e., the determination unit 130) may determine whether the conductive material is the audio jack 200, may control the detection and monitor unit 120 and the audio codec 19 based on a result of the determination of whether the conductive material is the audio jack 200, and may constantly access the peripheral circuit when the determination of whether conductive material is the audio jack is complete. For example, if a signal representing attachment of the audio jack 200 is received from the application processor 11, the audio codec 19 may output audio signals to the audio jack.

Figure 12:
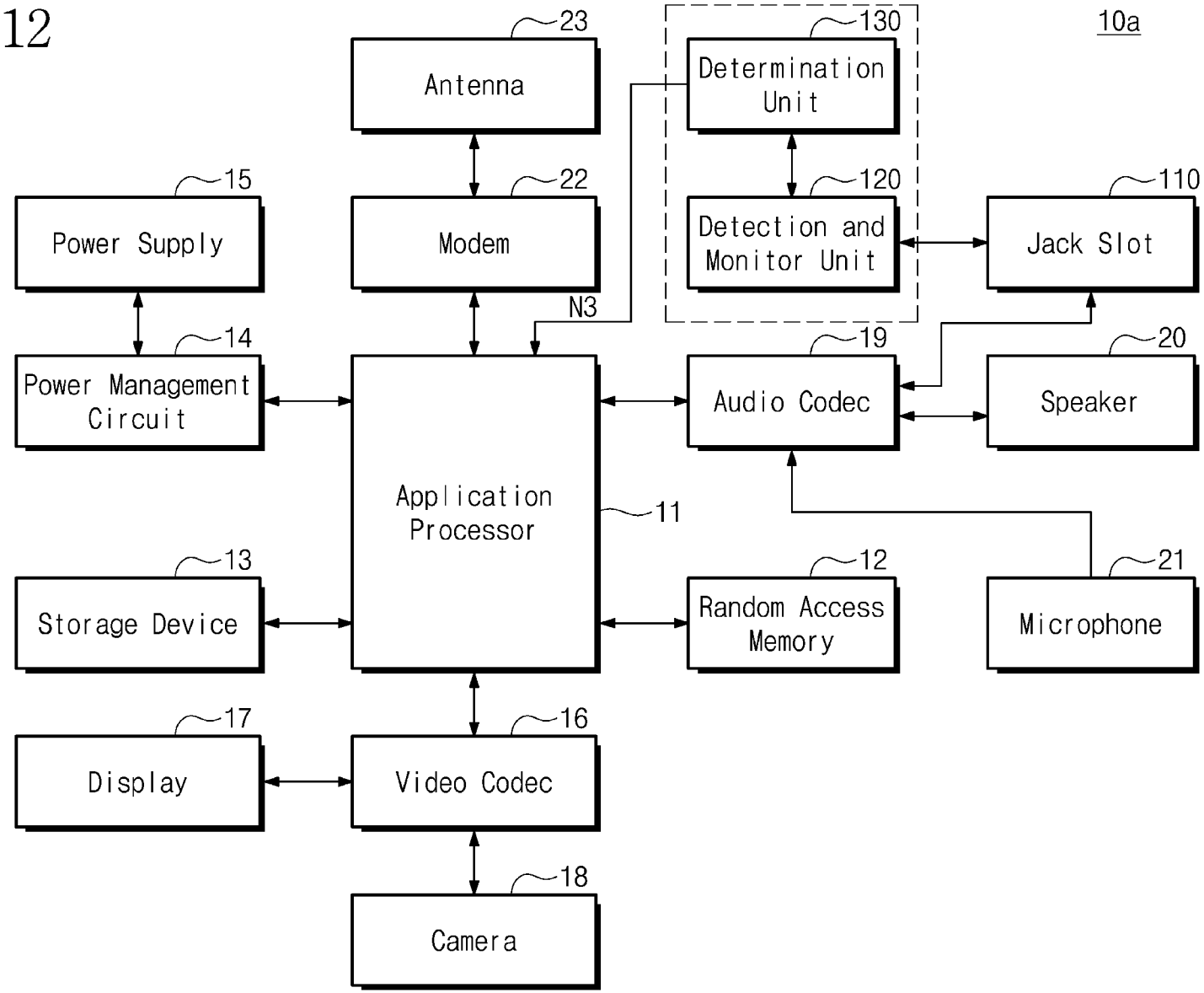
FIG. 12 illustrates a block diagram of an example of another multimedia device including the audio device according to an embodiment of the inventive concept.

FIG. 12 illustrates a block diagram of an example of another multimedia device 10*a* including the audio device 100 according to an embodiment of the inventive concept. Referring to FIGS. 1 and 12, the multimedia device 10*a* includes the application processor 11, the random access memory 12, the storage device 13, the power management circuit 14, the power supply 15, the video codec 16, the display 17, the camera 18, the audio codec 19, the speaker 20, the microphone 21, the modem 22, the antenna 23, the jack slot 110, the detection and monitor unit 120, and the determination unit 130.

Compared with the multimedia device 10 of FIG. 11, the determination unit 130 is disposed on the outside (i.e., external) of the application processor 11, not inside the determination unit 130. The detection and monitor unit 120 and the determination unit 130 may be implemented as or with a separate semiconductor integrated circuit which determines whether the audio jack 200 is attached to the jack slot 110.

If it is determined that the audio jack 200 is attached to the jack slot 110, the determination unit 130 may transmit a third notification N3 representing the attachment of the audio jack 200 to the application processor 11. In response to the third notification N3, the application processor 11 may recognize that the audio jack 200 is attached to the jack slot 110.

For example, the application processor 11 may control the audio codec 19 to transmit audio signals to the jack slot 110 when it is recognized that the audio jack 200 is attached to the jack slot 110. In other embodiments, the determination unit 130 may transmit the third notification N3 to the audio codec 19. In response to the third notification N3, the audio codec 19 may transmit audio signals to the jack slot 110.

Figure 13:
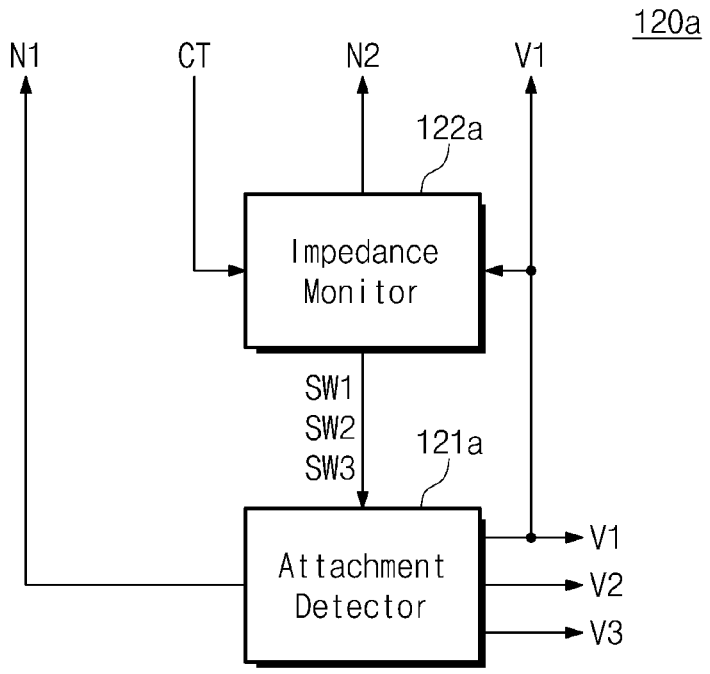
FIG. 13 illustrates a block diagram of detection and monitor unit according to an embodiment of the inventive concept.

FIG. 13 illustrates a block diagram of detection and monitor unit 120*a* according to another embodiment of the inventive concept. Referring to FIGS. 1 and 13, the detection and monitor unit 120*a* includes an attachment detector 121*a* and an impedance monitor 122*a*. Compared with FIG. 4, the impedance monitor 122*a* further transmits a third signal SW3 to the attachment detector 121*a*.

If it is determined that the audio jack 200 is attached to the jack slot 110, the determination unit 130 notifies the impedance monitor 122*a* that the audio jack 200 is attached, by using the control signal CT. In response to the control signal CT, the impedance monitor 122*a* activates the third signal SW3 to direct the attachment detector 121*a* to apply the third voltage V3.

Figure 14:
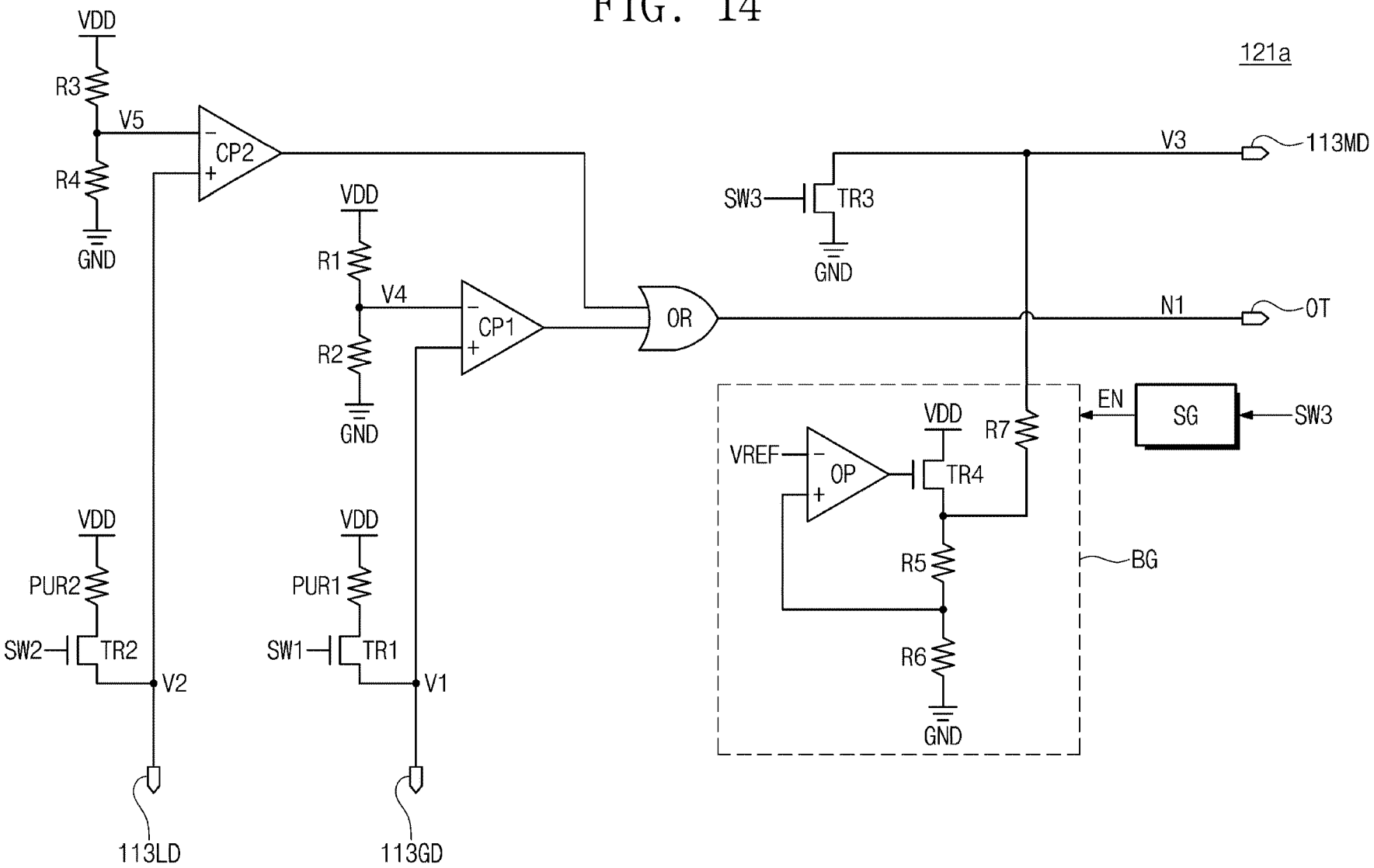
FIG. 14 illustrates an attachment detector of the detection and monitor unit of FIG. 13 according to an embodiment of the inventive concept.

FIG. 14 illustrates the attachment detector 121*a* of FIG. 13 according to an embodiment of the inventive concept. Referring to FIGS. 1, 13, and 14, the attachment detector 121*a* includes the first to fourth resistors R1 to R4, the first and second comparators CP1 and CP2, the first pull-up resistor PUR1, the logic gate circuit OR, the second pull-up resistor PUR2, the first to third transistors TR1 to TR3, the signal generator SG, and the bias voltage generation circuit B G.

Compared with FIG. 5, the third transistor TR3 operates in response to the third signal SW3 instead of the first notification N1. Also, the signal generator SG is activated in response to the third signal SW3. That is, the attachment detector 121*a* may apply the third voltage V3 to the jack slot 110 via microphone detection electrode 113MD after it is determined that a conductive material attached to the jack slot 110 is the audio jack 200, not when a conductive material is attached to the jack slot 110. For example, when it is determined that a conductive material attached to the jack slot 110 is the audio jack 200, the third signal SW3 is activated to a low level. When it is determined that a conductive material attached to the jack slot 110 is a conductive contaminant, the third signal SW3 is deactivated to a high level. Whether the audio jack 200 has the fourth pole 240 may be determined according to the third voltage V3.

Since supplying of the third voltage V3 to the jack slot 110 when a conductive contaminant is attached to the jack slot 110 is prevented, corrosion of the jack slot 110 due to the third voltage V3 may be further prevented (or suppressed). Accordingly, the lifespan of the audio device 100 may be improved.

According to embodiments of the inventive concept, when a conductive contaminant is attached to a jack slot, a jack detector detects an audio jack while supplying voltages to the jack slot periodically, not constantly. Since a time when current flows through the conductive contaminant decreases, an audio device capable of preventing rapid corrosion of the jack slot due to the conductive contaminant, and a corresponding operating method of the audio device, are provided.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. An audio device comprising:

a jack slot configured to be detachably connectable with an audio jack;

a detection and monitor circuit configured in a first detection mode to constantly supply a first voltage and a second voltage to the jack slot, and to detect whether a conductive material is attached to the jack slot depending on changes in the first and second voltages; and a determination circuit configured to determine whether the conductive material is the audio jack depending on a change in at least one of the first and second voltages in response to detection by the detection and monitor circuit that the conductive material is attached to the jack slot, wherein, in response to determination by the determination circuit that the conductive material is not the audio jack, the detection and monitor circuit is configured in a second detection mode to periodically monitor the change in the at least one of the first and second voltages by not supplying the first and second voltages to the jack slot during a first time interval of a period, by supplying the first and second voltages to the jack slot during a second time interval of the period, and repeating the period.

2. The audio device of claim 1, wherein in the first detection mode the detection and monitor circuit is configured to detect that the conductive material is attached when the first voltage is lower than a third voltage and the second voltage is lower than a fourth voltage.

3. The audio device of claim 1, wherein when the conductive material is detected as attached to the jack slot in the first detection mode, the detection and monitor circuit is configured to transmit to the determination circuit a notification representing that attachment of the conductive material is detected.

4. The audio device of claim 3, wherein, in response to the notification, the determination circuit is configured to convert the first voltage to a digital value and compare the digital value with values in a look-up table to determine whether the conductive material is the audio jack.

5. The audio device of claim 1, wherein the determination circuit is configured to transmit a first control signal to the detection and monitor circuit in response to determination that the conductive material is not the audio jack, and wherein, in response to the first control signal the detection and monitor circuit is configured in the second detection mode to not supply the first and second voltages to the jack slot during the first time interval and to digitize the first voltage to provide a first digital value while supplying the first and second voltages to the jack slot during the second time interval.

6. The audio device of claim 5, wherein, in the second detection mode, when the first digital value changes as much as a threshold value or more, the detection and monitor circuit is configured to transmit to the determination circuit a notification representing that the first digital value has changed.

7. The audio device of claim 6, wherein, in response to the notification, the determination circuit is configured to convert the first voltage to a second digital value and compare the second digital value with values in a look-up table to determine whether the conductive material is the audio jack.

8. The audio device of claim 7, wherein the determination circuit is configured to transmit a second control signal to the detection and monitor circuit in response to determination that the conductive material is not the audio jack, and wherein the detection and monitor circuit is configured to maintain the second detection mode in response to the second control signal.

9. The audio device of claim 1, wherein in response to determination by the determination circuit that the conductive material is the audio jack, the detection and monitor circuit is configured in the first detection mode to constantly supply the first and second voltages to the jack slot, and detect whether the audio jack is detached from the jack slot depending on changes in the first and second voltages.

10. The audio device of claim 1, wherein the detection and monitor circuit is further configured to detect whether the audio jack has a microphone pole, in response to determination by the determination circuit that the conductive material is the audio jack.

11. The audio device of claim 1, wherein the detection and monitor circuit comprises:

a first pull-up resistor and a first transistor connected between a ground detection electrode of the jack slot and a power node, the first transistor configured to provide the first voltage to the ground detection electrode when the first transistor is turned on;

a second pull-up resistor and a second transistor connected between a channel detection electrode of the jack slot and the power node, the second transistor configured to provide the second voltage to the channel detection electrode when the second transistor is turned on; and a first controller configured to constantly turn on the first and second transistors in the first detection mode, and to periodically turn on the first and second transistors in the second detection mode.

12. The audio device of claim 11, wherein the detection and monitor circuit further comprises:

a first comparator configured to output a low level when the first voltage of the ground detection electrode is lower than a third voltage;

a second comparator configured to output a low level when the second voltage of the channel detection electrode is lower than a fourth voltage; and a logic gate configured to output to the determination circuit a notification of a low level representing attachment of the conductive material, when outputs of the first and second comparators are low levels.

13. The audio device of claim 11, wherein the detection and monitor circuit further comprises:

a third transistor configured to apply a ground voltage to a microphone detection electrode of the jack slot under control of the first controller, in response to the determination by the determination circuit that the conductive material is not the audio jack; and a bias voltage generation circuit configured to apply a bias voltage to the microphone detection electrode of the jack slot under control of the first controller, in response to determination by the determination circuit that the conductive material is the audio jack.

14. The audio device of claim 11, wherein the detection and monitor circuit further comprises:

a first analog-to-digital converter configured to digitize the first voltage to provide a first digital voltage, and wherein the first controller deactivates the first analog-to-digital converter in the first detection mode, activates the first analog-to-digital converter in the second detection mode, and transmits a first notification representing a change in the first digital voltage to the determination circuit when the first digital voltage changes as much as a threshold value or more in the second detection mode.

15. The audio device of claim 14, wherein the determination circuit comprises:

a second analog-to-digital converter configured to digitize the first voltage to provide a second digital voltage; and a second controller configured to activate the second analog-to-digital converter in response to receiving from the detection and monitor circuit a second notification representing attachment of the conductive material, and to determine the conductive material is the audio jack or direct the detection and monitor circuit to enter the second detection mode, depending on a value of the second digital voltage, wherein the second controller is further configured to activate the second analog-to-digital converter in response to receiving the first notification representing the change in the first digital voltage, and to determine the conductive material is the audio jack or direct the detection and monitor circuit to maintain the second detection mode, depending on the value of the second digital voltage.

16. The audio device of claim 15, wherein a resolution of the second analog-to-digital converter is higher than a resolution of the first analog-to-digital converter.

17. An audio device comprising:

a jack slot configured to be detachably connectable with an audio jack;

a detection and monitor circuit configured in a first detection mode to constantly supply a first voltage and a second voltage to the jack slot, and to detect whether a conductive material is attached to the jack slot depending on changes in the first and second voltages;

an application processor configured to determine whether the conductive material is the audio jack depending on a change in at least one of the first and second voltages in response to detection by the detection and monitor circuit that the conductive material is attached to the jack slot; and an audio codec configured to transmit an audio signal to the jack slot in response to determination by the application processor that the conductive material is the audio jack, wherein, in response to determination by the application processor that the conductive material is not the audio jack, the detection and monitor circuit is configured in a second detection mode to monitor the change in the at least one of the first and second voltages while periodically supplying the first and second voltages to the jack slot.

18. The audio device of claim 17, further comprising:

a peripheral circuit including a modem, a storage device, and a random access memory, wherein the application processor controls the peripheral circuit, and wherein, when a notification representing attachment of the conductive material is received from the detection and monitor circuit, the application processor determines whether the conductive material is the audio jack, controls the detection and monitor circuit and the audio codec depending on a result of the determination, and constantly accesses the peripheral circuit when the determination is completed.

19. An audio device comprising:

a jack slot configured to be detachably connectable with an audio jack; and a detection and monitor circuit configured in a first detection mode to constantly supply a first voltage and a second voltage to the jack slot to detect whether a conductive material is attached to the jack slot depending on changes in the first and second voltages, and configured in a second detection mode to supply the first and second voltages to the jack slot to detect a change in a characteristic impedance of the conductive material attached to the jack slot during a first time interval of a period, wherein during a second time interval of the period of the second detection mode the detection and monitor circuit is configured to not supply the first and second voltages to the jack slot, the period being repeated in the second detection mode.

20. The audio device of claim 19, wherein the detection and monitor circuit is configured to provide a first notification upon detection of the conductive material attached to the jack slot, and to provide a second notification upon detection of the change in the characteristic impedance of the conductive material attached to the jack slot, the audio device further comprising a determination circuit connected to the detection and monitor circuit, the determination circuit configured upon receipt of one of the first and second notifications to determine whether the conductive material is the audio jack based on the first voltage.

* * * * *